US009470060B2

(12) United States Patent
Young et al.

(10) Patent No.: US 9,470,060 B2
(45) Date of Patent: Oct. 18, 2016

(54) STANDOFF DEVICE FOR DOWNHOLE TOOLS USING SLIP ELEMENTS

(75) Inventors: Jonathan Allen Young, Houston, TX (US); James Alan Rochen, Waller, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 701 days.

(21) Appl. No.: 13/605,239

(22) Filed: Sep. 6, 2012

(65) Prior Publication Data

US 2014/0060812 A1 Mar. 6, 2014

(51) Int. Cl.

| | |
|---|---|
| ***E21B 33/134*** | (2006.01) |
| ***E21B 33/129*** | (2006.01) |
| ***E21B 23/06*** | (2006.01) |
| ***E21B 33/12*** | (2006.01) |

(52) U.S. Cl.

CPC ..... *E21B 33/134* (2013.01); *E21B 23/06* (2013.01); *E21B 33/1204* (2013.01); *E21B 33/129* (2013.01); *E21B 33/1292* (2013.01)

(58) Field of Classification Search

CPC .. E21B 33/12; E21B 33/129; E21B 33/1291; E21B 33/134; E21B 33/1265; E21B 23/06

USPC ..... 166/118, 179

See application file for complete search history.

(56) References Cited

U.S. PATENT DOCUMENTS

| | | | | |
|---|---|---|---|---|
| 2,187,481 | A * | 1/1940 | Baker et al. | 166/121 |
| 3,783,941 | A | 1/1974 | Kisling, III | |
| 4,586,567 | A * | 5/1986 | Jameson | 166/121 |
| 5,390,737 | A | 2/1995 | Jacobi | |
| 5,984,007 | A | 11/1999 | Yuan et al. | |
| 7,475,736 | B2 * | 1/2009 | Lehr et al. | 166/386 |
| 2005/0069691 | A1 | 3/2005 | Sutton | |
| 2008/0060821 | A1 * | 3/2008 | Smith et al. | 166/387 |
| 2009/0038790 | A1 | 2/2009 | Barlow | |
| 2010/0006280 | A1 * | 1/2010 | Porter et al. | 166/134 |
| 2011/0024134 | A1 | 2/2011 | Buckner | |
| 2011/0079383 | A1 | 4/2011 | Porter et al. | |
| 2012/0061105 | A1 * | 3/2012 | Neer et al. | 166/387 |
| 2012/0097384 | A1 | 4/2012 | Valencia et al. | |
| 2013/0048305 | A1 * | 2/2013 | Xu et al. | 166/376 |

FOREIGN PATENT DOCUMENTS

CN 202 300 300 U 7/2012

OTHER PUBLICATIONS

Patent Examination Report No. 1 in counterpart Australian Appl. 2013219196, dated Mar. 6, 2015.

Notice of Allowance in counterpart Canadian Appl. 2,824,103, dated Sep. 2, 2014.

Extended Search Report in counterpart EP Appl. 13183239.6, dated Nov. 20, 2015.

* cited by examiner

*Primary Examiner* — Michael Wills, III

(74) *Attorney, Agent, or Firm* — Blank Rome LLP

(57) ABSTRACT

A device and method for use is provided for grippingly engaging a tubular, in particular for gripping a wellbore casing. Drillable bridge plugs may use hardened buttons or other slip arrangements and materials that may be susceptible to damage when the bridge is being run into the wellbore. It may be desirable to protect the slip ring or the hardened buttons by shielding the buttons during run-in or by providing a standoff device so that the buttons may be prevented from contacting the casing until desired.

18 Claims, 6 Drawing Sheets

STANDOFF DEVICE FOR DOWNHOLE TOOLS USING SLIP ELEMENTS

CROSS-REFERENCE TO RELATED APPLICATIONS

BACKGROUND

In drilling oil and gas wells, it is often necessary to isolate zones within a wellbore in order to achieve well control. Zones are typically isolated by setting packers or plugs at specified locations within the wellbore. These downhole tools can be used for a number of purposes. In the case of flow diversion, packers allow fluid to be diverted from the tool through perforations in the wellbore. Typically, composite plugs are used for temporary applications to plug a well. Most commonly they are used when a wellbore intersects multiple production zones. The terms "packer" and "plug" are used interchangeably herein.

Packer assemblies usually include an elastomeric material to seal the annulus and a slip assembly to secure the packer assembly against the casing. Typically, a slip assembly includes a slip and a cone or wedge, located about the mandrel, wherein the slip is used to grip the casing, typically by partially penetrating the casing wall. A slip will usually be a complete ring or segmented ring formation. The outer surface of the slip usually has sharp edges to bite the casing, which are made of a material harder than the casing in order to penetrate the casing. The inner edge of the slip may be biased to sit on the face of the cone, such that the slip can ride up the cone during the setting process. A packer assembly is set by using a setting tool to apply axial pressure to the assembly causing the slip and the cone to move towards each other in the longitudinal direction. As the slip and the cone move towards each other the slip is forced over the cone and moves radially outward to bite the casing.

With the advent of drillable bridge plugs and packers, such as composite or aluminum bridge plugs and packers, it has become desirable to minimize the amount of hard or otherwise difficult to drill material that may be utilized in a bridge plug or packer. Typically a composite or otherwise drillable bridge plug or packer is, as the name suggests, easily drillable. Unfortunately, the slip assembly, in order to function may be very hard and consequently very dense. Upon setting the slip assembly is forced radially outward, breaking the slip ring into smaller pieces. When it is time to drill out the bridge plug the drill or mill bit progresses to the location adjacent to the broken bits of the slip ring but the mud flow typically is not sufficient to circulate out all of the dense pieces of the slip ring therefore pieces of the slip ring fall towards the bottom of the well. The pieces of the slip ring then accumulate on the next lower bridge plug. The metal pieces may then be lodged in the drill or begin to rotate with the drill, causing difficulty in further drilling.

In order to prevent dense pieces of the slip rings from accumulating downhole, one solution is to utilize a composite or otherwise drillable and less dense slip ring and then embedding hardened teeth, such as ceramic or cermet teeth, into the slip ring. The hardened teeth are smaller and usually less dense or at least configured to maximize the surface area of each piece.

Typically when a ceramic or other hardened button is embedded in the slip ring, the sharp outer edges of the ceramic or hardened button can be damaged before the embedded button is fully set in the casing, reducing the ability of the embedded button to bite the casing. Additionally, when the bridge plug is being run into the wellbore, the outer edges of the slip or the embedded buttons may be chipped when the slip or buttons make contact with the casing. Typically, most of the damage to the edges of the slip occurs during setting when an embedded button may be moved longitudinally along the casing while partially embedded in the casing during the setting process.

When longitudinal pressure is first applied to the bridge plug or packer assembly, the slip ring and any embedded buttons are forced to move longitudinally along the cone while also moving radially outward. The radial movement of the slip ring will cause the embedded buttons to contact the casing. As more pressure is applied, the slip ring longitudinally along the cone, causing the outer edge of the embedded buttons to drag along the casing while digging further into the casing. This drag tends to cause the sharp edges of the embedded buttons or the slip ring to chip as the bridge plug or packer assembly moves to its final set position. This damage to the embedded buttons reduces the performance of the embedded buttons and the slip assembly in gripping the casing.

There is a need in the art to identify a way to prevent chipping of these buttons while reducing metallic content. This invention addresses this problem.

SUMMARY

This invention relates to one or more slip assemblies to be used with downhole tools for anchoring. The slip can be in a ring or segmented configuration. The slip may be made of a composite, a nonmetallic material, or any other easily drilled material. The slip assembly may include one or more buttons (or inserts) that may be any material that is harder than the casing, but is typically a ceramic material. The slip assembly also includes one or more standoff devices to provide separation of the button(s) from the casing. The standoff device may have an outer diameter greater than, or at least equal to, that of the button(s).

The standoff device acts as a buffer between the buttons and the casing, minimizing the buttons contact with the casing and therefore reducing chipping of the buttons. During run-in and setting of the packer, the standoff device allows for greater separation of the buttons from the casing and may even provide a barrier between the buttons and the casing, which protects the buttons and reduces drag prior to final setting. Because the standoff device has an outside diameter greater than or at least equal to the buttons' outer diameter, the standoff device will reduce the buttons contact with the casing or may even make contact with the casing before the buttons, reducing the chipping of the buttons.

DETAILED DESCRIPTION OF EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
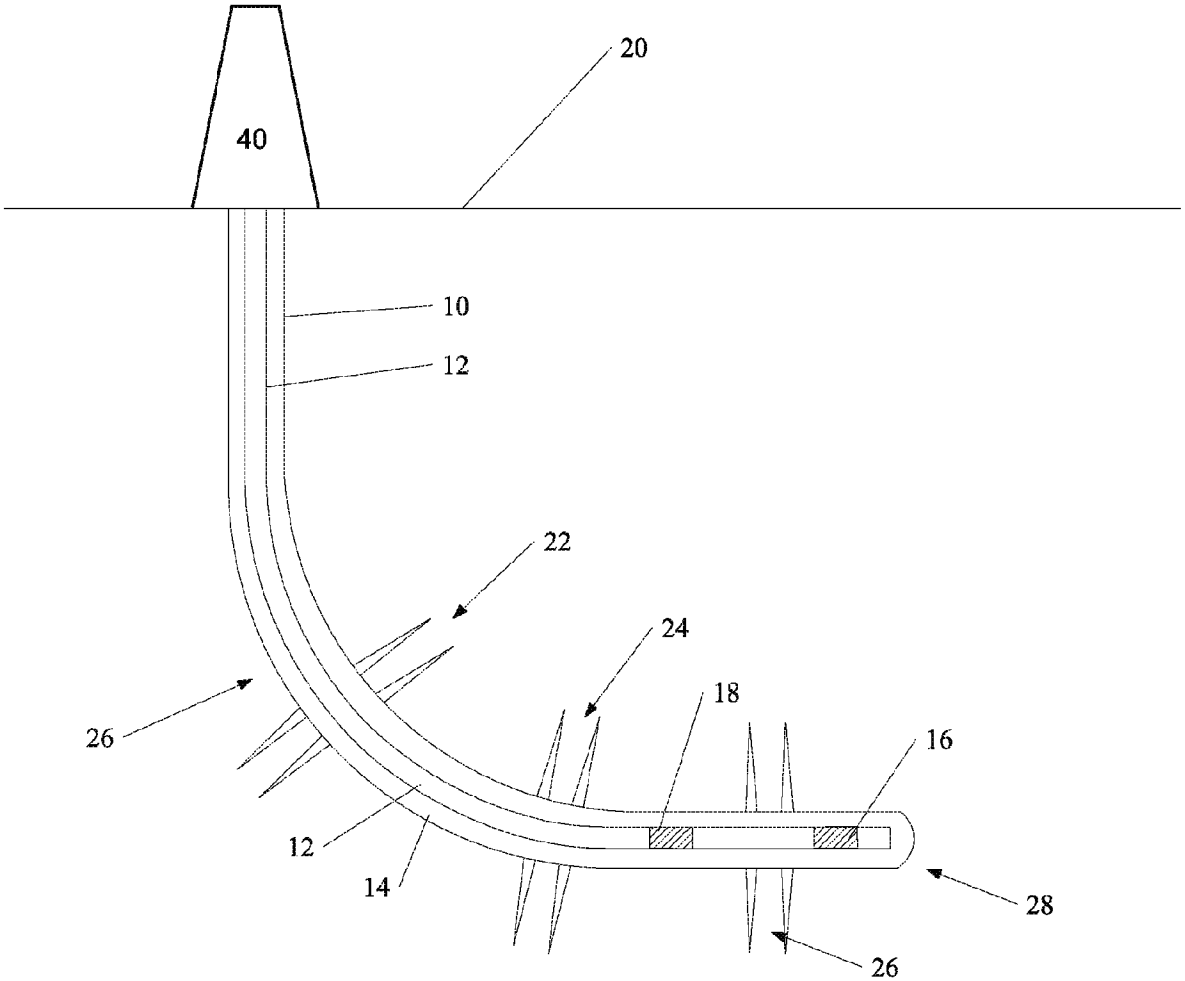
FIG. 1 depicts a wellbore with multiple formation zones each separated by a bridge plug.

FIG. 1 depicts a wellbore 10 extending from a rig 40 on the surface 20, through the heel 26 of the well, to the toe 28 or lower and of the well. Wellbore casing 12 is run into the wellbore 10 and then the annular area 14, between the casing 12 and the wellbore 10 is filled with cement. The cement is pumped from the surface 20 through the casing 14 and finally into annular area 14 to fix the casing 12 into place within the wellbore 10.

Once the wellbore 10 is cased each zone is typically accessed and treated in order to produce hydrocarbons from the zone. To access a formation zone such as zone 26 a bridge plug 16 may be run in to the well below zone 26, towards the toe 28. The bridge plug 16 is then actuated to lock it into place in the casing 12 and to isolate a portion of the wellbore 10 or casing 12 below the bridge plug 16. A perforation gun or other tool may then be run into the casing 12 until the perforation gun or other tool is adjacent to zone 26. Holes will then be created through the casing 12, including any cement that may be in the annular area 14, to allow direct access to zone 26. The process is then repeated for each successively higher zone. For instance zone 24 would be the next zone accessed starting by placing a second bridge plug 18 between zones 26 and 24.

Once each zone has been accessed and treated the operator may remove the bridge plugs, such as bridge plugs 16 and 18 as well as any bridge plugs that were placed to access any other zone adjacent to the casing 12 above zone 24 such as zone 22. Typically the plugs are removed by milling or drilling them out.

Figure 2:
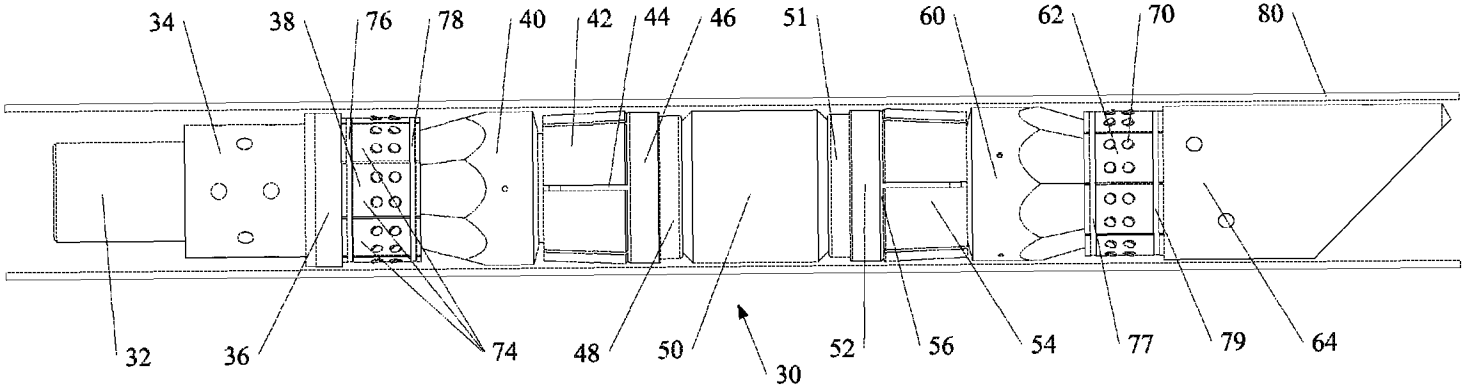
FIG. 2 depicts a composite bridge plug in the run-in condition.

FIG. 2 depicts an embodiment of a composite bridge plug 30. The composite bridge plug 30 has a mandrel 32, each of the additional bridge plug assemblies are concentrically mounted around the mandrel 32. An upper end cap 34 is mounted on the mandrel 32 at the upper end of the bridge plug elements. The upper end cap 34 is mounted adjacent to the upper push ring 36 that in turn is mounted adjacent to the slip ring 38. The slip ring 38 has a partially angled inner surface that in the unset position partially resides directly on the mandrel 32 and partially resides upon the cooperating angled surface of the slip wedge 40.

Adjacent to the slip wedge 40 are three element support rings 42, 44, and 46. Element support rings 42 and 44 each have an angled inner surface and are notched into petals such that the notches of element support ring 42 will be placed approximately at the center of the petals of element support ring 44. Element support ring 46 is typically Teflon but could be any elastomer, plastic, polymer, or other material that resists extrusion. An end ring 48 may be placed between the element support rings 42, 44, and 46 and the sealing element 50.

The sealing element 50 is typically the center of the bridge plug and the bridge plugs elements above the sealing element 50 are repeated moving below the sealing element 50 such that an end ring 52 may be placed between the element support rings 52, 54, and 56, and the sealing element 50. Element support ring 52 is typically Teflon but could be any elastomer or plastic that resists extrusion. Element support rings 54 and 56 each have an angled inner surface and are notched into petals such that the notches of element support ring 54 will be placed approximately at the center of the petals of element support ring 56. Adjacent to the three element support rings 52, 54, and 56 is slip wedge 60.

The slip wedge 60 has an outer angled surface. The adjacent slip ring 62 has a partially angled inner surface that in the unset position partially resides directly on the mandrel 32. The slip ring's 62 partially angled inner surface also partially resides upon the cooperating angled surface of the slip wedge 60. Adjacent to the slip ring is the lower end cap 64. The lower end cap 64 is rigidly fixed to the mandrel 32. Each of the slip rings 38 and 62 has a number of embedded buttons 70 to grip the casing. In some instances the slip rings 38 and 62 may be comprised of a number of slip bodies 74 that may be held in place by slip retaining bands 76, 77, 78, and 79.

Figure 3:
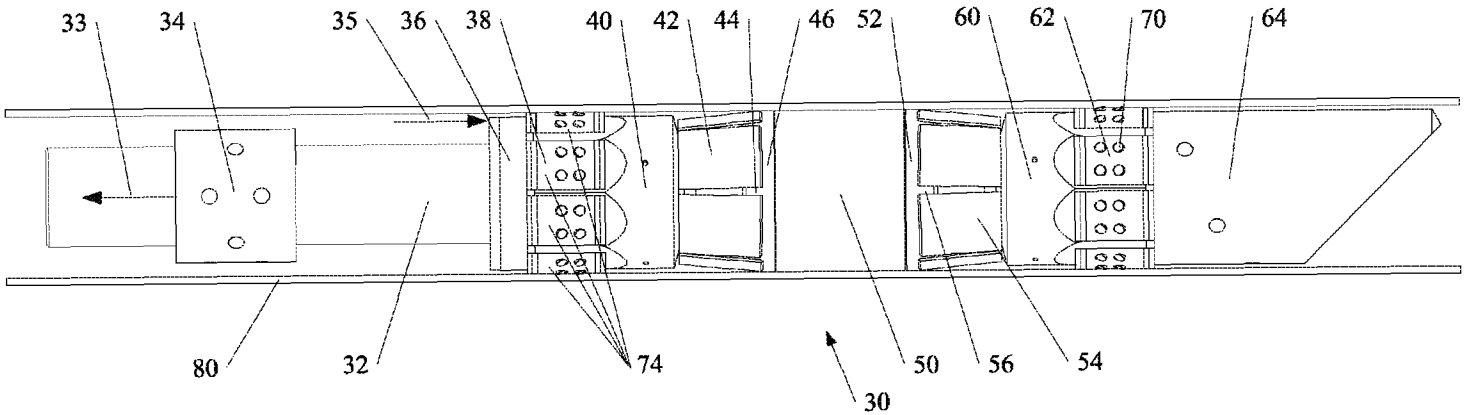
FIG. 3 depicts a composite bridge plug in the set condition.

FIG. 3 depicts a bridge plug 30 that has been set inside casing 80. When a bridge plug 30 transitions from its unset position as depicted in FIG. 2 and its set position as depicted in FIG. 3 typically the mandrel 32 is pulled upwards, as depicted by arrow 33, and the push ring 36 is pushed downwards as depicted by arrow 35. End cap 64 is rigidly affixed to the mandrel 32 so that as the mandrel 32 is pulled upwards end cap 64 is also pulled upwards. However, each of the elements that surround the mandrel 32 are being pushed downwards by the push ring 36 sliding longitudinally along the mandrel 32.

As upper push ring 36 is also forced along the mandrel 32 towards the end cap 64, the upper push ring 36 in turn pushes the slip ring 38 towards the end cap 64. As the slip ring 38 moves towards the end cap 64 the partially angled inner diameter of the slip ring 38 is forced along the complementary angled outer diameter of the slip wedge 40. As the slip ring 38 is forced along the slip wedge 40 the complementary angled surfaces of each function to force the slip ring 38 to move radially outwards as it moves longitudinally towards end cap 64. As the slip ring 38 moves radially outwards the outer diameter of the slip ring 38 increases proportionally causing the slip retaining bands 76 and 78 to break, in turn allowing the slip bodies, such as slip bodies 74, to move separately along the slip wedge 40. As the slip bodies 74 continue to move radially outward eventually the embedded buttons 70 begin to contact the casing 80. The embedded buttons 70 continue to dig deeper into the casing 80 as the slip bodies 74 continue to move downwards towards end cap 64.

As the slip ring 38 is forced along the slip wedge 40 the slip ring 38 forces the slip wedge 40 against the element support rings 42, 44, and 46. The element support rings 42, 44, and 46 in turn push downwards against the sealing element 50.

In a similar manner, due to the same forces, and concurrently with the movement of the elements as occurred above the sealing element 50. Below the sealing element 50, the end cap 64 is pulled towards the push ring 36 causing the adjacent slip ring 62 to be pulled towards the push ring 36. As the slip ring 62 moves towards the push ring 36 the partially angled inner diameter of the slip ring 62 is forced along the complementary angled outer diameter of the slip wedge 60. As the slip ring 62 is forced along the slip wedge 60, the complementary angled surfaces of the slip ring 62 and the slip wedge 60, function to force the slip ring 62 to move radially outwards as it moves longitudinally towards push ring 36. As the slip ring 62 moves radially outwards the outer diameter of the slip ring 62 increases proportionally. As the outer diameter of the slip ring 62 increases, the slip retaining bands 77 and 79 break, allowing the slip bodies 74 to move separately along the slip wedge 60. As the slip bodies 74 continue to move radially outward eventually the embedded buttons 70 begin to contact the casing 80. The embedded buttons 70 continue to dig deeper into the casing 80 as the slip bodies 74 continue to move downwards towards upper end cap 34.

As the slip ring 62 is forced along the slip wedge 60 the slip ring 62 forces the slip wedge 60 against the element support rings 54, 56, and 52. The element support rings 54, 56, and 52 in turn push downwards against the sealing element 50.

Compressing sealing element 50 from each end, element support ring 42 and 54 are each pushed towards the sealing element 50. Element support ring 42 is pushed by slip wedge 40 and element support ring 54 is pushed by slip wedge 60. Lying just under element support rings 42 and 54 are element support rings 44 and 56 respectively. Laying partially under element support rings 44 and 56 as well as between the end rings 48 and 51, respectively, and the element support rings 44 and 56 is a third element support ring 46 and 52. Element support ring 46 is above the sealing element 50 while element support ring 52 is below the sealing element 50. As end cap 64 and push ring 36 are forced towards each other the third element support rings 48 and 51 are forced under the element support rings 56 and 44. Element support rings 44 and 56 are located radially inward of the element support rings 42 and 54. Each of the element support rings 42, 44, 54, and 56 are constructed so that they may form petals to allow them to increase in diameter on the end nearest to sealing element 50 while they are constrained from radially expanding on the end away from the sealing element 50. Typically the petals of the element support rings 42 and 54 are placed such that as the petals expand the gaps between the petals overlay the petals formed by elements support rings 44 and 56.

As the bridge plug continues to transition to the set position the third elements support rings 46 and 52, that typically have a higher resistance to extrusion than the sealing element 50 but may not seal as well as the sealing element 50, is forced into any gaps that may be left between the now expanded element support rings 42, 44, 54, and 56 and the sealing element 50.

Finally, sealing element 50 is axially compressed by pressure against end rings 48 and 51 causing the sealing element 50 to radially expand, sealing the area between the mandrel 32 and the casing 80. At the same time the sealing element 50 may extrude a certain amount flowing over the end rings 48 and 51 and filling any gap left between the third element support rings 46 and 52.

Figure 4:
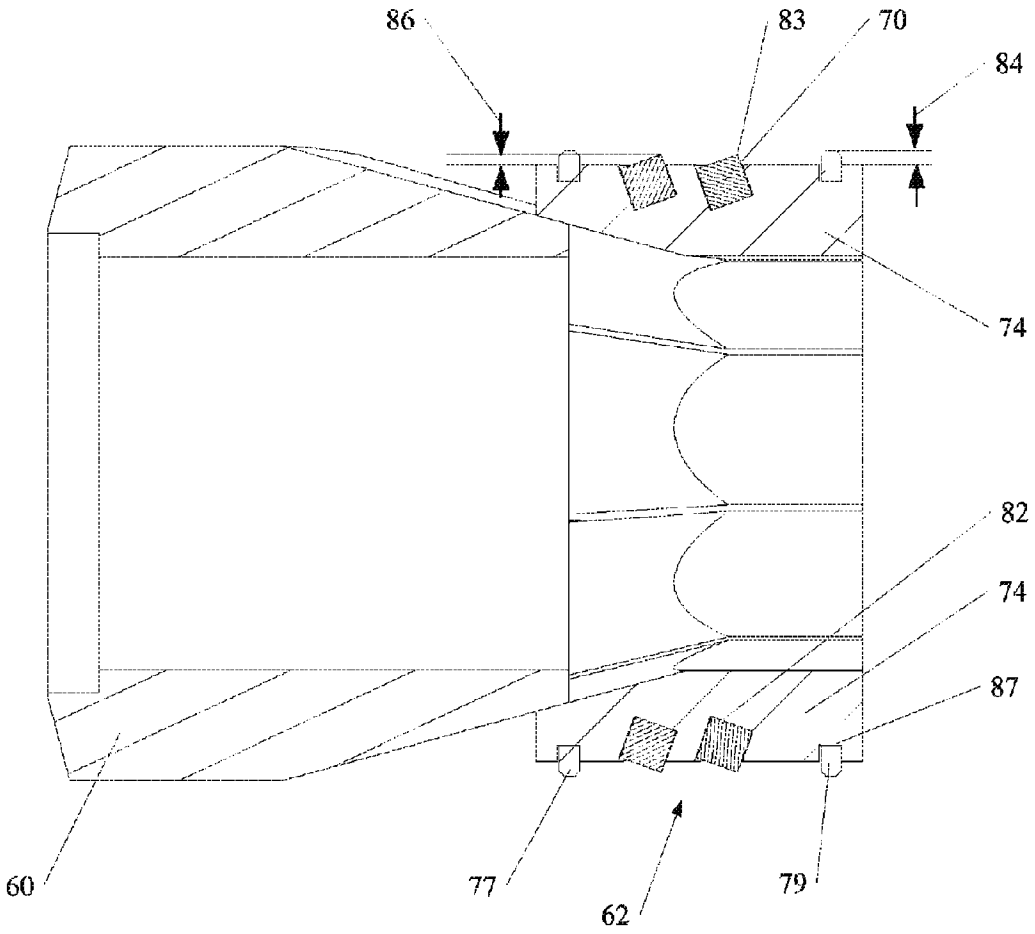
FIG. 4 depicts a cross-section of a slip ring and slip wedge with standoff slip retaining bands.

FIG. 4 depicts a cross-section of the slip wedge 60 and the slip ring 62. Typically, the slip ring 60 is comprised of six or eight slip bodies 74. Each slip body 74 includes one or more buttons or inserts 70. The buttons 70 may be recessed into the corresponding number of cavities 82 on the face of the slip body 74. The buttons 70 may be any material that will penetrate the casing 80. Each of the buttons typically has one or more sharp edges 83 that protrude from the face of the slip body 74, however, the buttons or inserts 70 may take any form or shape. Typically, the buttons 70 may be made of ceramic or cermet materials, although other sufficiently hard material that may penetrate the casing including cast iron, titanium carbide, or tungsten carbide may be used. The buttons 70 protrude from the face of the slip body 74 a distance 86.

As depicted in FIG. 3, as the slip ring 62 is forced along the slip wedge 60, the complementary angled surfaces of the slip ring 62 and the slip wedge 60, function to force the slip ring 62 to move radially outwards as it moves longitudinally upwards towards push ring 36. As the slip bodies 74 continue to move radially outward eventually the embedded buttons 70 begin to contact the casing 80.

In one embodiment, depicted in FIG. 4, the slip rings 62 include slip retaining bands 77 and 79. While the slip retaining bands 77 and 79 may hold the individual slip bodies 74 in place on the mandrel 32 at least one of the slip retaining bands 77 or 79 may be used as a standoff device. The slip retaining band 77 or 79 is placed around the slip ring 62 in a band cavity 86. The slip retaining band 77 or 79 protrudes from the face of the slip body 74 at a height 84, which is greater than the height 86 of the buttons 70. The increased height 84 of the slip retaining band 77 or 79 prevents the buttons 70 from contacting the casing prematurely thereby minimizing any potential damage to the button 70. In other arrangements the slip buttons may be incorporated into the slip body 74. The slip bodies 74 could be incorporated into the slip ring 60.

The slip retaining band 77 or 79 may be made of any material with sufficient strength to prevent the button 70 from prematurely contacting the casing 80 although the material preferably allows the slip retaining band 77 or 79 to give way so that the buttons 70 may bite the casing during setting. Preferably, the slip retaining band 77 or 79 is made of a molded plastic material that will flow out of the way when pressure is applied. The slip retaining bands 77 and 79 may also be made of brittle materials that may break or crush during setting to allow the buttons to grip the casing 80 on demand. In FIG. 4, while slip retaining bands 77 and 79 are located on either side of the group of buttons 70, it is not necessary to use this layout.

Figure 5:
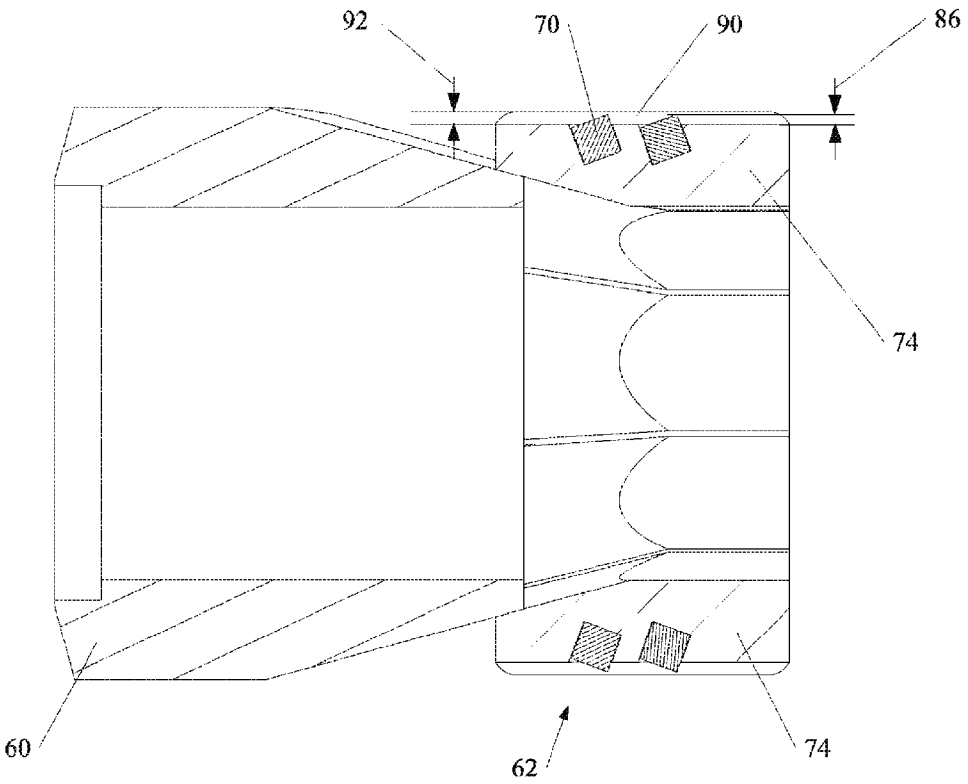
FIG. 5 depicts a cross-section of a slip ring and slip wedge with a standoff slip retaining shroud.

FIG. 5 depicts an embodiment of the invention wherein the slip ring 62 includes slip shroud 90. The slip shroud 90 may hold the individual slip bodies 74 in place on the mandrel 32. The slip shroud 90 may be used as a standoff device. The slip shroud 90 is set or molded around the slip ring 62 and may substantially cover the slip buttons 70. The slip shroud 90 protrudes from the face of the slip body 74 at a height 92, which is greater than the height 86 of the buttons 70. The increased height 92 of the slip shroud prevents the buttons 70 from contacting the casing prematurely thereby minimizing any potential damage to the button 70.

The slip shroud 90 may be made of any material with sufficient strength to prevent the buttons 70 from prematurely contacting the casing 80 although the material preferably should give way to allow the buttons 70 to bite the casing during setting. Preferably, the slip shroud 90 is made of a molded plastic material that will flow out of the way when pressure is applied. The slip retaining bands 77 and 79 may also be made of a brittle material that may break or crush during setting to allow the buttons to grip the casing 80 on demand.

Figure 6:
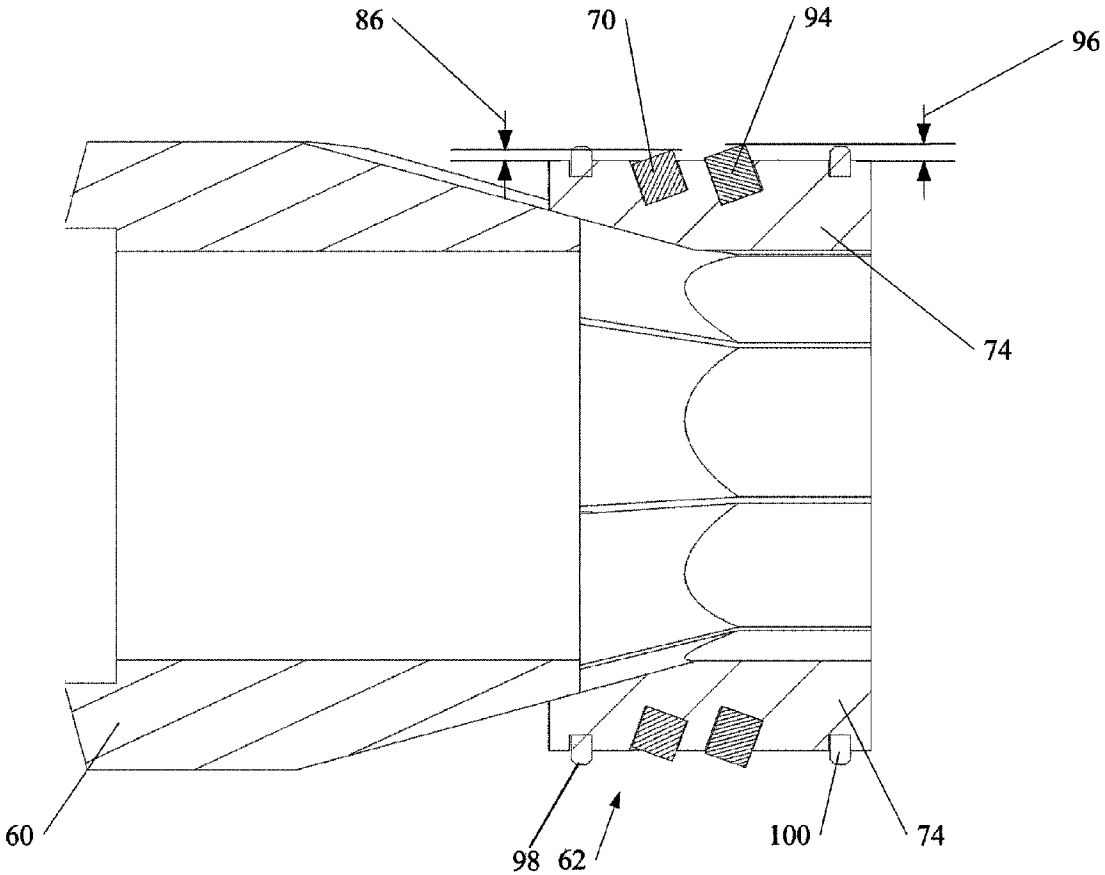
FIG. 6 depicts a cross-section of a slip wedge and slip bodies with standoff buttons.

FIG. 6 depicts an embodiment of the invention wherein the slip rings 62 include a standoff button 94. The slip retaining bands 98 and 100 may hold the individual slip bodies 74 in place on the mandrel 32. The standoff button 94 protrudes from the face of the slip body 74 at a height 96, which is greater than the height 86 of the buttons 70. The increased height 96 of the standoff button 94 prevents the buttons 70 from contacting the casing prematurely thereby minimizing any potential damage to the button 70.

The standoff button 94 may be made of any material with sufficient strength to prevent the buttons 70 from prematurely contacting the casing 80 although the material preferably should give way to allow the buttons 70 to bite the casing during setting. Preferably, the standoff button 94 may be a brittle material that may break or crush during setting to allow the buttons to grip the casing 80 on demand. A standoff button 94 may be made of the same material as the buttons 70 but configured such that the standoff button 94 may break or otherwise be sacrificed on demand. The standoff button 94 could also be a molded plastic material that will flow out of the way when pressure is applied.

Figure 7:
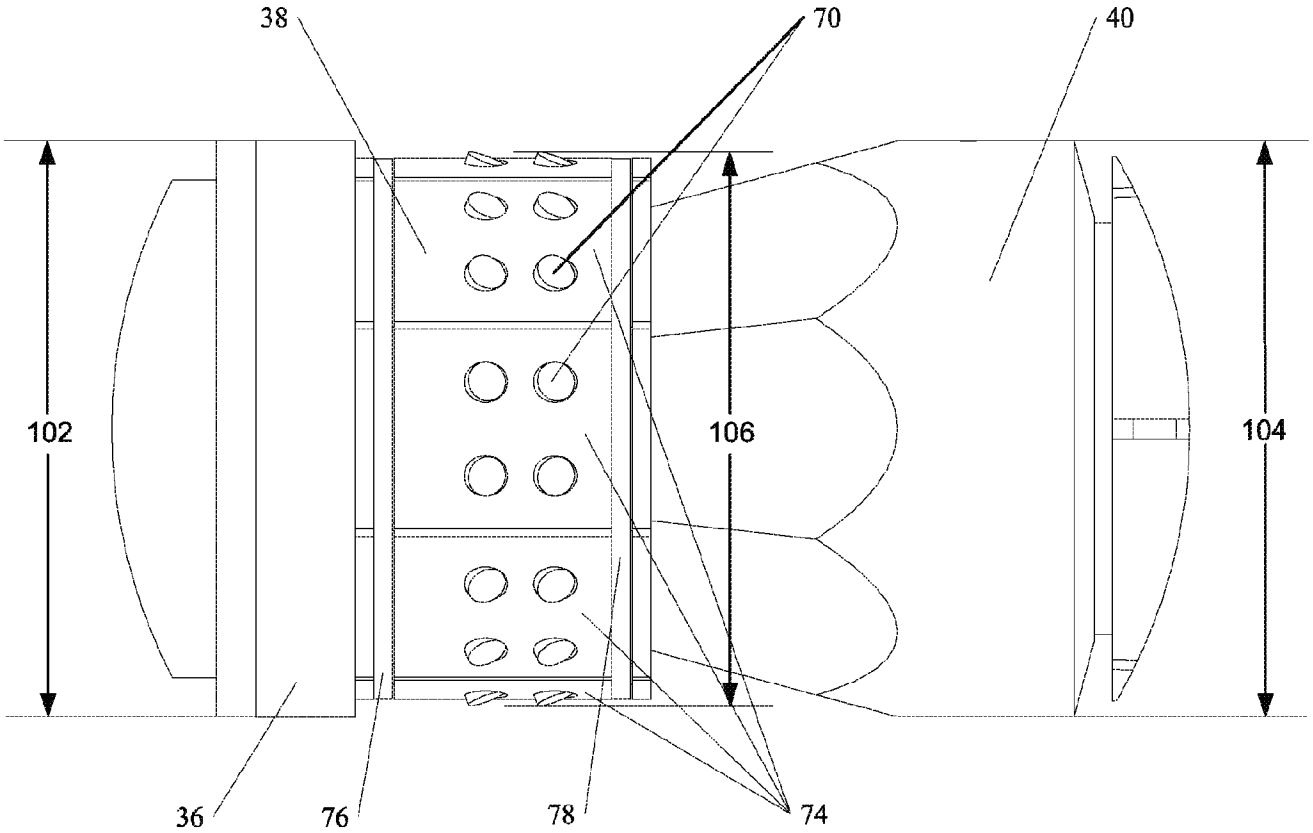
FIG. 7 depicts a partial view of a drillable bridge plug

FIG. 7 depicts a section of a bridge plug including a slip ring 38, an upper push ring 36, a slip wedge 40, slip bodies 74, slip retaining bands 76 and 78, and buttons 70. The upper push ring 36 has a diameter 102 and the slip wedge 40 has a diameter 104. Typically diameters 102 and 104 will be approximately the same. The buttons 70 have a diameter 106. The buttons 70 diameter 106 is less than the upper push ring 36 diameter 102 and the slip wedge 40 diameter 104. Typically diameter 106 is about 0.2 inches less than diameter 102 and 104. By keeping the buttons 70 diameter 106 less than the upper push ring 36 diameter 102 and the slip wedge diameter 104 as the bridge plug 30 is run into a wellbore or casing the upper push ring 36 and the slip wedge 40 tend to shield the buttons from any protrusions or other items in the wellbore or casing that could impact or otherwise damage any of the buttons 70. It should be understood that any of the structure adjacent to a button 70 could be used to shield the button 70 by decreasing the diameter of the buttons 70 or increasing the diameter of the adjacent structure.

Any of the embodiments described may be utilized alone or in conjunction with any other embodiment of the present invention.

While the embodiments are described with reference to various implementations and exploitations, it will be understood that these embodiments are illustrative and that the scope of the inventive subject matter is not limited to them. Many variations, modifications, additions and improvements are possible. For example, the implementations and techniques used herein may be applied to liner hangers or any other device that utilizes gripping teeth moving longitudinally while also moving radially outwards to engage a surface.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A drillable bridge plug comprising:

a mandrel;

at least one slip assembly having gripping teeth, wherein the slip assembly is further comprised of at least two slip bodies and wherein the gripping teeth have a first outer diameter; and a standoff ring, wherein the standoff ring secures the slip bodies to the mandrel and has a second outer diameter greater than the first outer diameter.

2. The drillable bridge plug in claim 1 wherein the gripping teeth are buttons.

3. The drillable bridge plug in claim 2 wherein the buttons are ceramic.

4. The drillable bridge plug in claim 2 wherein the buttons are cermet.

5. The drillable bridge plug in claim 1 wherein the standoff ring is a molded polymer.

6. The drillable bridge plug of claim 1, comprising a slip wedge disposed on the mandrel and having a third outer diameter greater than the second outer diameter of the standoff ring.

7. A drillable bridge plug comprising:

a mandrel;

at least one slip assembly having gripping teeth, wherein the gripping teeth have a first outer diameter; and a standoff shroud, wherein the standoff shroud has a second outer diameter greater than the first outer diameter and substantially covers the gripping teeth.

8. The drillable bridge plug in claim 7 wherein the gripping teeth are buttons.

9. The drillable bridge plug in claim 8 wherein the buttons are ceramic.

10. The drillable bridge plug in claim 8 wherein the buttons are cermet.

11. The drillable bridge plug in claim 7 wherein the slip assembly is further comprised of at least two slip bodies.

12. The drillable bridge plug in claim 11 wherein the standoff shroud secures the slip bodies to the mandrel.

13. The drillable bridge plug in claim 7 wherein the standoff shroud is a molded polymer.

14. The drillable bridge plug of claim 7, comprising a slip wedge disposed on the mandrel and having a third outer diameter greater than the second outer diameter of the standoff ring.

15. A drillable bridge plug comprising:

a mandrel;

at least one slip assembly having gripping teeth, wherein the slip assembly is further comprised of at least two slip bodies, wherein the gripping teeth have a first outer diameter; and a standoff shroud, wherein the standoff shroud has a second outer diameter greater than the first outer diameter and secures the slip bodies to the mandrel.

16. The drillable bridge plug in claim 15, wherein the gripping teeth comprise ceramic or cermet buttons.

17. The drillable bridge plug in claim 15, wherein the standoff shroud is a molded polymer.

18. The drillable bridge plug of claim 15, comprising a slip wedge disposed on the mandrel and having a third outer diameter greater than the second outer diameter of the standoff ring.

* * * * *